US005394671A

United States Patent [19]

Taylor

[11] Patent Number: 5,394,671

[45] Date of Patent: * Mar. 7, 1995

[54] CARDBOARD SPACER/SEAL AS THERMAL INSULATOR

[76] Inventor: Donald M. Taylor, 3844 Sundown Dr., Nanaimo, British Columbia V9T 4H5, Canada

[ * ] Notice: The portion of the term of this patent subsequent to Mar. 1, 2011 has been disclaimed.

[21] Appl. No.: 135,709

[22] Filed: Oct. 13, 1993

[51] Int. Cl.[6] ..... E09C 2/54

[52] U.S. Cl. ..... 52/790

[58] Field of Search ..... 52/790, 788, 789

[56] References Cited

U.S. PATENT DOCUMENTS 4,613,530 9/1986 Hood et al. ..... 52/790 X 5,290,611 3/1994 Taylor ..... 52/790 X

*Primary Examiner*—Carl D. Friedman

*Assistant Examiner*—Creighton Smith

[57] ABSTRACT

A multi-paned insulated light, such as a window, incorporates an interior panel spacer/seal that includes a thermal insulating layer of cardboard. The cardboard serves as a low cost insulating layer and may be used in conjunction with rolled or extruded metal spacer forms, so as to vastly diminish the thermal bridging effect normally present with such metallic sections. The cardboard spacer can be used adjoining either the "cold" pane or the "hot" pane of the multi-paned unit, or may be interposed between adjacent metallic sections, as a thermal break therebetween. The cardboard is preferably sealed with a surface sealing layer such as polyvinyl alcohol, to effectively preclude gas percolation therepast.

15 Claims, 2 Drawing Sheets

CARDBOARD SPACER/SEAL AS THERMAL INSULATOR

TECHNICAL FIELD

This invention is directed to multi-paned lights, such as windows, and in particular to an insulative spacer/-seal between adjacent lights incorporating a cardboard insulative layer.

BACKGROUND ART

In the glazing industry the use of multi-paned window lights for use in windows, doors, patio doors and the like has grown tremendously, due to the greater insulative protection that these provide.

However, the problem of thermal bridging is associated with metallic spacer/seal sections.

Efforts to overcome or substantially diminish the thermal bridging effect have included such things as the provision of two metal sections with a thermal break barrier therebetween, such as a urethane layer between the metal sections. While reasonably thermally efficient, such systems are unduly costly, costing in the price range of $1.64 per linear meter of seal length (i.e. $0.50 per linear foot).

Other attempted solutions to the problem have included extruded plastic spacer/seals, and other applied and over-extruded thermoplastic thermal insulators. However, in addition to expense, such spacer/seals are subject to outgassing, which over time can contaminate the enclosed sealed space between the panes, with consequent loss of insulative efficiency and optical clarity.

One solution to the spacer/seal problems, as set forth in my copending U.S. patent application Ser. Nos. 07/609,336, 07/925,537 and 08/081,530, respectively filed Nov. 5, 1990, Aug. 5, 1992 and Jun. 23, 1993 is the use of a hollow cardboard section, wherein utilization is made of the high linear insulative value of cardboard.

DISCLOSURE OF THE INVENTION

However, I now find that the insulative value of cardboard, with its microporous cellular structure, is of such high order that it is possible to use an ostensibly solid piece of cardboard as an effective insulating layer in conjunction with metal spacer sections, such as existing metal seals.

Such a cardboard-composite spacer/seal construction can equal or even exceed the thermal performance of the aforementioned expensive composite spacer/seal incorporating a urethane thermal barrier, and at significantly lower cost, and with increased convenience and facility of use.

The possibility of outgassing and/or gas or water vapour migration through the cardboard may be effectively precluded by use of polyvinyl alcohol as a protective coating or sheath to the cardboard.

The incorporation of such a sealing component into the initial making of the cardboard also is contemplated, in carrying out the present invention.

Certain of the advantages in the use of cardboard as an applied or an interposed sealing layer, in conjunction with metallic spacer/seals is the case with which the cardboard can be incorporated as an edge layer or as an interposed thermal barrier layer. Thus, a spacer/seal "flame" or "flames" can be made up of a metal section, sized to the periphery of the light being manufactured, and the cardboard, as an outer layer or as an intermediate barrier can then be bonded to an edge or edges of the spacer frame, so as to complete the spacer/seal, for installation between the panes of the light. Thus an effective cardboard thermal barrier layer may comprise a cardboard ribbon.

In accordance with general practice, it is contemplated that the physical strength of the spacer/seal will be complemented with an outer peripheral seal of polysulphide sealant, as the cardboard component of the spacer seal develops its greatest structural strength in compression, and may be liable to lamination if subject to tension.

It has been found that adequate thermal insulation may be provided with cardboard as thin as 14½ mill size. Increased mill thickness promotes greater insulative capacity.

The present invention thus provides a spacer/seal for use with multi-paned lights in interposed spacing and sealing relation therewith, having a thermal barrier of cardboard in interposed relation with a structural spacer, such as a metallic spacer.

In view of the excellent insulative quality of the cardboard spacer it is contemplated that the construction of the metallic spacing element may be greatly simplified, as its thermal conductivity characteristics are no longer critical, so that the use of very thin metal sections or of special metals is no longer paramount, and lower cost metals and fabrication techniques, and more robust metal sections may be adopted, in combination with the cardboard thermal barrier layer.

However, the present invention enables the continued use of metal spacer sections presently in use, complemented by the simple addition of a sealed cardboard layer, integrated as an edge seal or seals, or as an interposed thermal brake between a pair of metallic spacer sections.

I have found that the insulative value of cardboard exceeds that of the rubbers which have been used, heretofore as adhesive and insulating edging.

Thus there is provided a spacer seal for use with a multi-paned light, the spacer seal having a structural frame, and an interposed thermal barrier of cardboard to limit thermal conduction between adjacent panes through the structural frame.

The cardboard may be sealed with a sealant such as polyvinyl alcohol.

The sealant may be provided as a surface coating to the cardboard.

A further moisture-proof sealing layer such as SARAN (TM) may be used to further protect the integrity of the seal.

The aforesaid structural frame may include a hollow metal section having at least one peripheral edge surface to receive a layer of cardboard in adjoining, thermally insulating relation therewith, interposed in the thermal conductivity path between the adjacent panes. The layer of cardboard may be in the form of a cardboard ribbon.

In the case of metal sections having profiled edge surfaces, the cardboard layer may be conformed with the profile.

The invention thus provides a multi-paned light combined with a spacer/seal between a pair of adjacent panes, the spacer/seal being in the form of a frame, including at least one cardboard layer in thermally interposed relation with a thermal conductivity path extending between the panes, by way of the frame of the spacer/seal.

The aforesaid combination includes an outer, peripheral seal of polysulphide sealant.

The aforesaid cardboard layer includes a plastic sealant to substantially preclude passage of fluids into and through the cardboard.

The cardboard strip for carrying out the invention may incorporate a layer or layers of pressure sensitive adhesive with a protective release cover, for application to existing spacer/seal sections.

BEST MODE OF CARRYING OUT THE INVENTION

Figure 1:
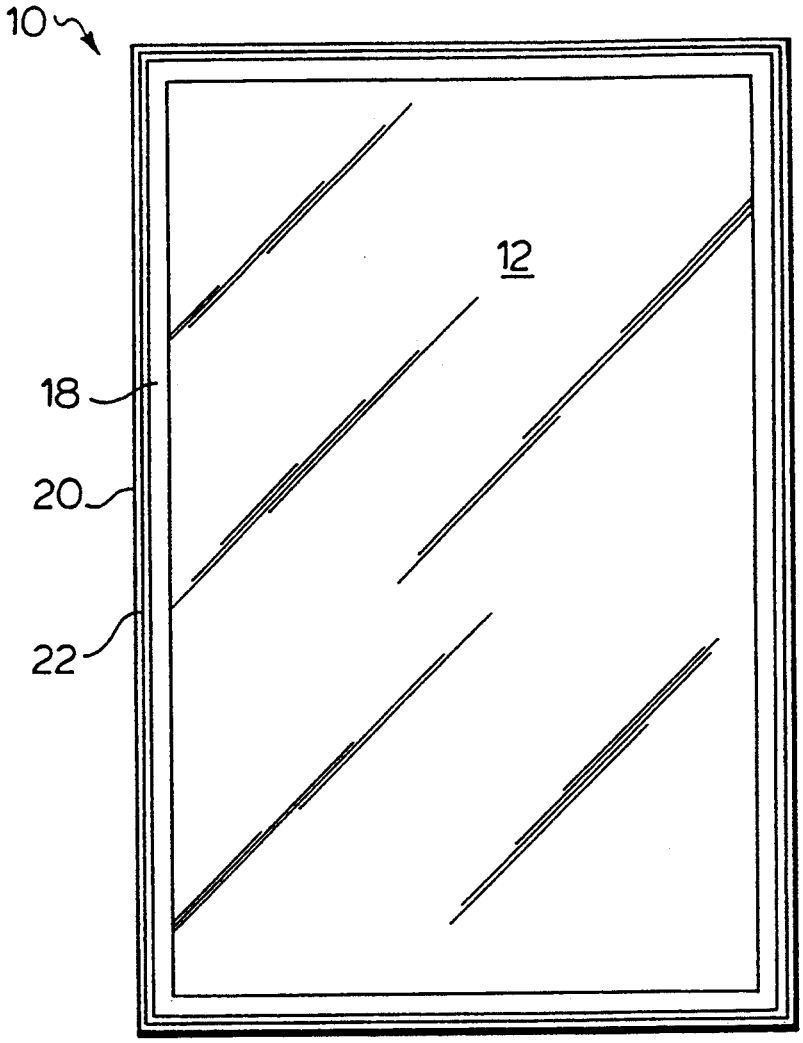
FIG. 1 is a schematic side view of a light incorporating a spacer/seal peripheral frame in accordance with the present invention.

Referring to FIG. 1, a frameless multi-paned glazing unit 10 has a spaced-apart pair of glass panels, the rear panel 12 being seen. The outer periphery comprises an enclosing polysulphide seal 20, within which a portion of metallic spacer 22 is shown.

A cardboard insulating spacer/seal ribbon 18 is interposed between the inner face of the glass 12 and the metal spacer 22. The metal spacer 22 is made up as a peripheral frame, installed within the outer periphery of the panel or pane 12, being hermetically enclosed by the polysulphide seal 20.

The edge of metal spacer 22, adjacent the pane 12, is separated therefrom by the overlying cardboard layer of spacer/seal 18.

Figure 2:
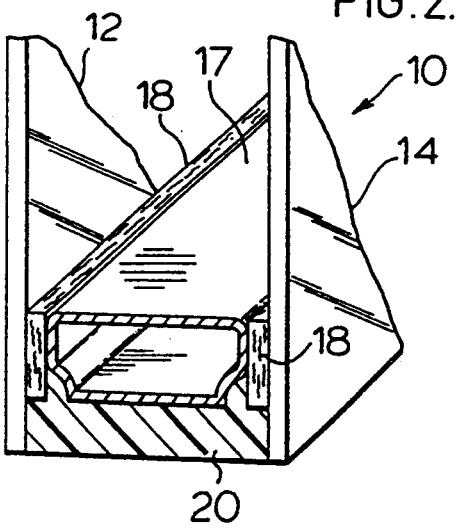
FIG. 2 is a section in end perspective showing one embodiment of the present invention.
Figure 3:
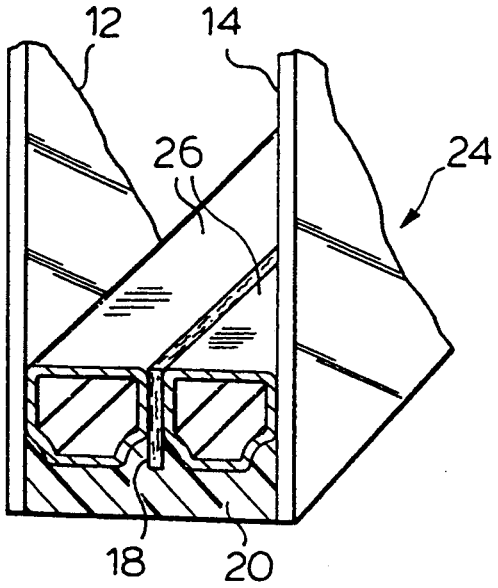
FIG. 3 is a view similar to FIG. 2, showing a second embodiment of the invention.
Figure 4:
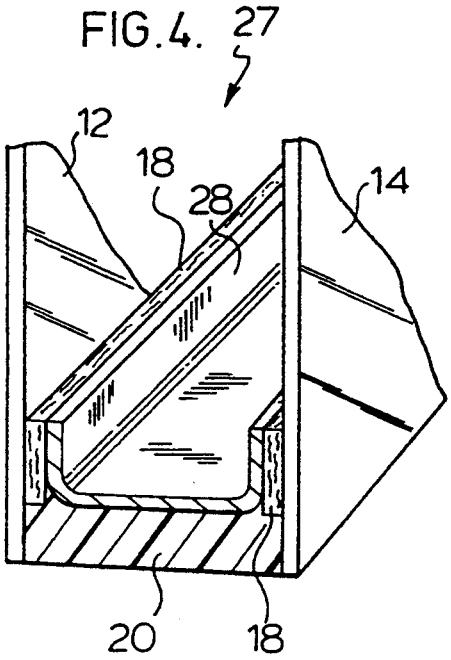
FIGS. 4 and 5 are views similar to FIGS. 2 and 3 showing a third and a fourth embodiment of the invention.
Figure 5:
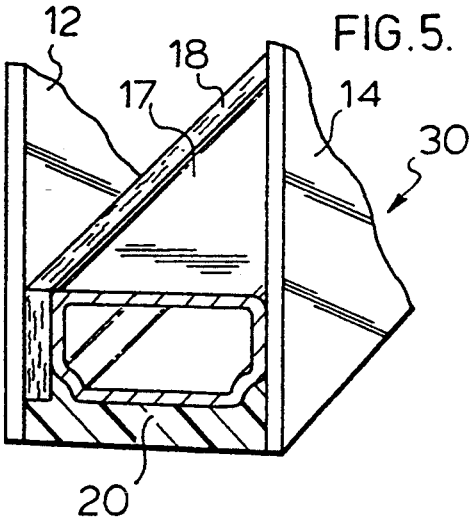

Referring to FIG. 2, in the seal assembly 10, the pane 12 may be considered as the "cold" face of the unit 10, the other pane, 14 being considered as the "warm" face, as is the case also in FIGS. 3, 4 and 5.

A metallic spacer 17 has both sides thereof bounded by cardboard spacer/seals 18, sealingly bonded to the spacer 17 and to the adjoining surfaces of panes 12 and 14 respectively.

Referring to FIG. 3, the seal arrangement 24 comprises a pair of like metal sections 26, each sealingly bonded by its outer edge to the adjoining inner face of panes 12 and 14 respectively.

A cardboard spacer/seal 18 is interposed between and sealingly bonded to the adjoining inner edge faces of the metal sections 26, so as to form a thermal break therebetween.

Referring to FIG. 4, the arrangement 27 shows a metal spacer 28 of U-section having both outer edges thereof thermally isolated from the adjacent glass faces of panes 12, 14, by way of cardboard spacer/seals 18. Both faces of the spacer/seals 18 are sealingly bonded to the respective adjoining surfaces.

In the FIG. 5 arrangement 30, the single cardboard spacer/seal 18 is shown installed at the "cold" edge of a metallic spacer 17.

In each of the above cases a polysulphide peripheral seal 20 is shown.

It will be understood that the location of the thermally insulating cardboard spacer/seal may be adjoining either or both the "cold" and the "warm" pane of the glazing unit.

It will be evident, in view of the present practice of fabricating metallic spacer/seal sections into a peripheral frame formulation, that introduction of a cardboard spacer/seal 18, by bonding one or more thereof to one or more edges of the fabricated metal frame is extremely simple.

The installation of the modified spacer/seal between the panes of the unit is virtually unchanged. The same may be said for the application of the outer polysulphide peripheral seal which encloses the outer edge of the glazing unit.

INDUSTRIAL APPLICABILITY

This invention is of major commercial importance in that it is readily applicable to most, if not all presently existing insulation systems, in order to significantly enhance their insulative quality.

What is claimed is:

1. A cardboard insulating ribbon of restricted width, having a plastic sealing component to preclude percolation of fluids therethrough, for use in combination with spacer seals in multi-paned glazing units, to provide an insulative thermal break between the inner faces of adjacent panes of a said unit.

2. The insulating ribbon as set forth in claim 1, having a thickness of 14 mill or greater.

3. The insulating ribbon as set forth in claim 1, wherein said plastic sealing component comprises polyvinyl alcohol.

4. The insulating ribbon as set forth in claim 2, wherein said plastic sealing component comprises polyvinyl alcohol.

5. The insulating sealing ribbon as set forth in claim 3, wherein said polyvinyl alcohol comprises a surface layer.

6. The cardboard insulating ribbon as set forth in claim 1, in combination with a spacer/seal for use in a multi-paned glazing unit, said ribbon being sealingly bonded to at least one side of said spacer/seal, to provide an insulative thermal break thereto.

7. The combination as set forth in claim 6, said spacer seal comprising a metallic section.

8. The combination as set forth in claim 7, comprising a pair of said metallic sections, having said cardboard ribbon sealingly bonded therebetween to provide a transverse thermal break between the outer edges of said sections.

9. The combination as set forth in claim 6, having two of said ribbons bonded in sealing relation to opposed outer edges of said spacer/seal, said spacer/seal being made up into a frame.

10. The combination as set forth in claim 6, combined with a pair of glazing panes, having said insulated spacer/seal bonded in sealed, spacing relation between said panes.

11. The combination as set forth in claim 7, combined with a pair of glazing panes, having said insulated spacer/seal bonded in sealed, spacing relation between said panes.

12. The combination as set forth in claim 8, combined with a pair of glazing panes, having said insulated spacer/seal bonded in sealed, spacing relation between said panes.

13. The combination as set forth in claim 10, including a second, outer peripheral seal in sealed, enclosing relation with said spacer/seal.

14. The combination as set forth in claim 11, including a second, outer peripheral seal in sealed, enclosing relation with said spacer/seal.

15. The combination as set forth in claim 12, including a second, outer peripheral seal in sealed, enclosing relation with said spacer/seal.

* * * * *